US005738065A

United States Patent [19]

Linnel

[11] Patent Number: 5,738,065

[45] Date of Patent: Apr. 14, 1998

[54] VARIABLE ROTARY ENGINE

[76] Inventor: Jean Linnel, 9458 Firstone Blvd., Apartment 7, Downey, Calif. 90241

[21] Appl. No.: 697,787

[22] Filed: Aug. 30, 1996

[51] Int. Cl.[6] ..... F02B 53/00

[52] U.S. Cl. ..... 123/242; 418/28

[58] Field of Search ..... 123/242; 418/16, 418/28, 61.2

[56] References Cited

U.S. PATENT DOCUMENTS

| | | |
|---|---|---|
| 1,797,905 | 3/1931 | Dooley . |
| 2,517,862 | 8/1950 | Frederick . |
| 2,909,033 | 10/1959 | Hill, II . |
| 3,109,381 | 11/1963 | Baker . |
| 3,224,198 | 12/1965 | Schimkat . |
| 3,584,984 | 6/1971 | Majkowski . |
| 4,188,176 | 2/1980 | Traut . |
| 4,758,137 | 7/1988 | Kieper . |

FOREIGN PATENT DOCUMENTS

| | | | |
|---|---|---|---|
| 1912529 | 10/1970 | Germany | 418/28 |

*Primary Examiner*—Michael Koczo

*Attorney, Agent, or Firm*—Curtis L. Harrington

[57] ABSTRACT

A rotary engine contains a laterally displaceable rotary member which is sealably and slidably engaged by a rotor plate which has been modified for sealing, travels in an eccentric circle along with the rotor, but provides sealing against the rotor using corner seals and surface seals, and is also further sealed against the engine housing so that combustion gasses in the vicinity of the rotor and rotor plate do not escape either between the rotor and rotor plate surfaces nor between the rotor plate surfaces and the engine housing surfaces. The other end of the rotor rotatably depends from a reducing piston which is sealably engaged against the internal portion of the engine so that it can travel laterally, in order to laterally displace the rotor. During engine operation, the rotor can be made to be axially displaced or pushed through the rotor plate to lower the effective combustion volume. The reducing piston is physically manipulated from outside of the engine by actuation of a plurality of push-pull rods which connect the reducing piston ultimately to an actuator. An actuator is used to operate the push-pull plate and a sensor can be utilized to measure the displacement of the push-pull rods and plate to better control the resulting engine displacement.

14 Claims, 7 Drawing Sheets

VARIABLE ROTARY ENGINE

This invention claims priority from a provisionally filed application Ser. No. 60/003,125 filed on Sep. 1, 1995.

FIELD OF THE INVENTION

The present invention relates to the field of internal combustion engines and more particularly to a Wankel rotary-type engine, but having structure to enable the size of the combustion volume to be continuously varied to yield higher efficiency operation.

BACKGROUND OF THE INVENTION

The Wankel rotary engine has been in use for some time and has offered mechanical motion efficiencies over that of a standard internal combustion engine chiefly because the continuous inertia of the internal moving parts. However, the mechanical efficiency gained from having a continuous mechanical motion has been offset by inefficiency in overall use and a generally lower fuel efficiency derived from overall use.

At high power outputs, a sort of efficiency is obtained where the mechanical efficiency helps to facilitate power output at high power output. In general useage, however and where only a portion of the output power is needed, the inefficiency in operation dominates. The full volume displacement of the engine still requires a large volume of air to be compressed, and much of the energy value from the fuel is spent in compressing the still large volume of air pulled into the combustion chamber.

SUMMARY OF THE INVENTION

The rotary engine of the present invention contains a laterally displaceable rotary member which is sealably and slidably engaged by a rotor plate which has been modified for sealingly allowing the rotor to be pushed through it. The rotor plate travels in an eccentric circle along with the rotor, but provides sealing against the rotor using corner seals and surface seals, and is also further sealed against the engine housing so that combustion gasses in the vicinity of the rotor and rotor plate do not escape either between the rotor and rotor plate surfaces nor between the rotor plate surfaces and the engine housing surfaces.

The other end of the rotor rotatably depends from a reducing piston which is sealably engaged against the internal portion of the engine so that it can travel laterally, in order to laterally displace the rotor. During engine operation, the rotor can be made to be axially displaced or pushed through the rotor plate to lower the effective combustion volume.

The spark plug, inlet and exhaust ports are located relatively close to the rotor plate so as to never become isolated by lateral movement of the reducing piston. The reducing piston is physically manipulated from outside of the engine by actuation of a plurality of push-pull rods which connect the reducing piston ultimately to an actuator. In a preferred embodiment, the push-pull rods are connected to a push-pull plate and it is the push pull plate which is actuated in order to actuate the push-pull rods simultaneously. An actuator is used to operate the push-pull plate and a sensor can be utilized to measure the displacement of the push-pull rods and plate to better control the resulting engine displacement.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
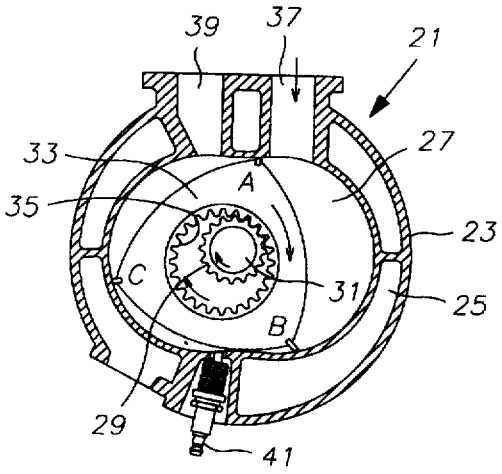
FIG. 1 (PRIOR ART)
FIG. 1 is schematic view of a prior art rotary engine in a position where it will intake a fuel and air mixture.

The description and operation of the invention will be best described with reference to FIG. 1. FIG. 1 is a schematic lateral section view of a prior art rotary engine 21. The engine 21 has an engine housing 23 which includes a plurality of cooling water ports 25 and a combustion chamber 27.

The stationary gear 29 is surrounded by a rotor 33 having an internally disposed rotor gear 35 which engages the stationary gear 29 as the rotor 33 eccentrically rotates. The positions A, B, and C are shown to illustrate the positions of the rotor as it progresses through the rotary cycle.

As is well known, FIG. 1 illustrates the rotary engine 21 in its intake position as an air-fuel mixture is drawn through an inlet manifold 37. Also seen is the exhaust manifold 39 and a standard electric spark plug 41.

Figure 2:
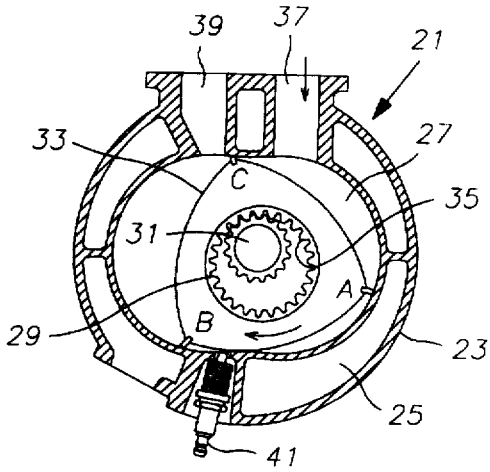
FIG. 2 (PRIOR ART)
FIG. 2 is a schematic view of the prior art rotary engine shown in FIG. 1 in compression position.
Figure 3:
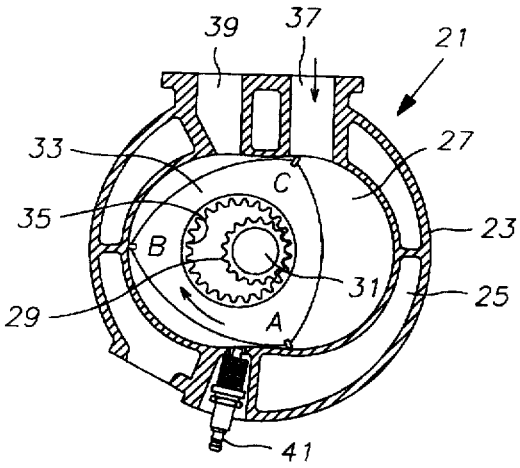
FIG. 3 (PRIOR ART)
FIG. 3 is a schematic view of the prior art rotary engine shown in FIGS. 1 and 2 and illustrating the power position.

Referring to FIG. 2, a the rotary engine 21 has advanced to the compression position where the air-fuel mixture previously admitted is being compressed. Referring to FIG.

Figure 4:
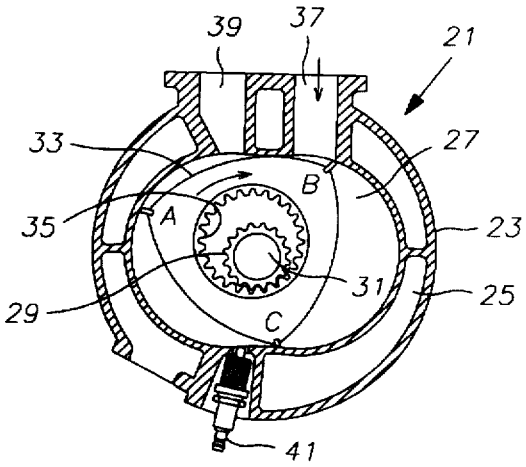
FIG. 4 (PRIOR ART)
FIG. 4 is a schematic view of the prior art rotary engine shown in FIGS. 1–3 and illustrating the exhaust position.

3, the power position is shown as the point at which the spark plug ignites the air fuel mixture. FIG. 4 illustrates the exhaust position, where combustion gasses exit the exhaust manifold 39. Having thus illustrated the basic working of the prior art as a starting point, the inventive structure will be better understood.

Figure 5:
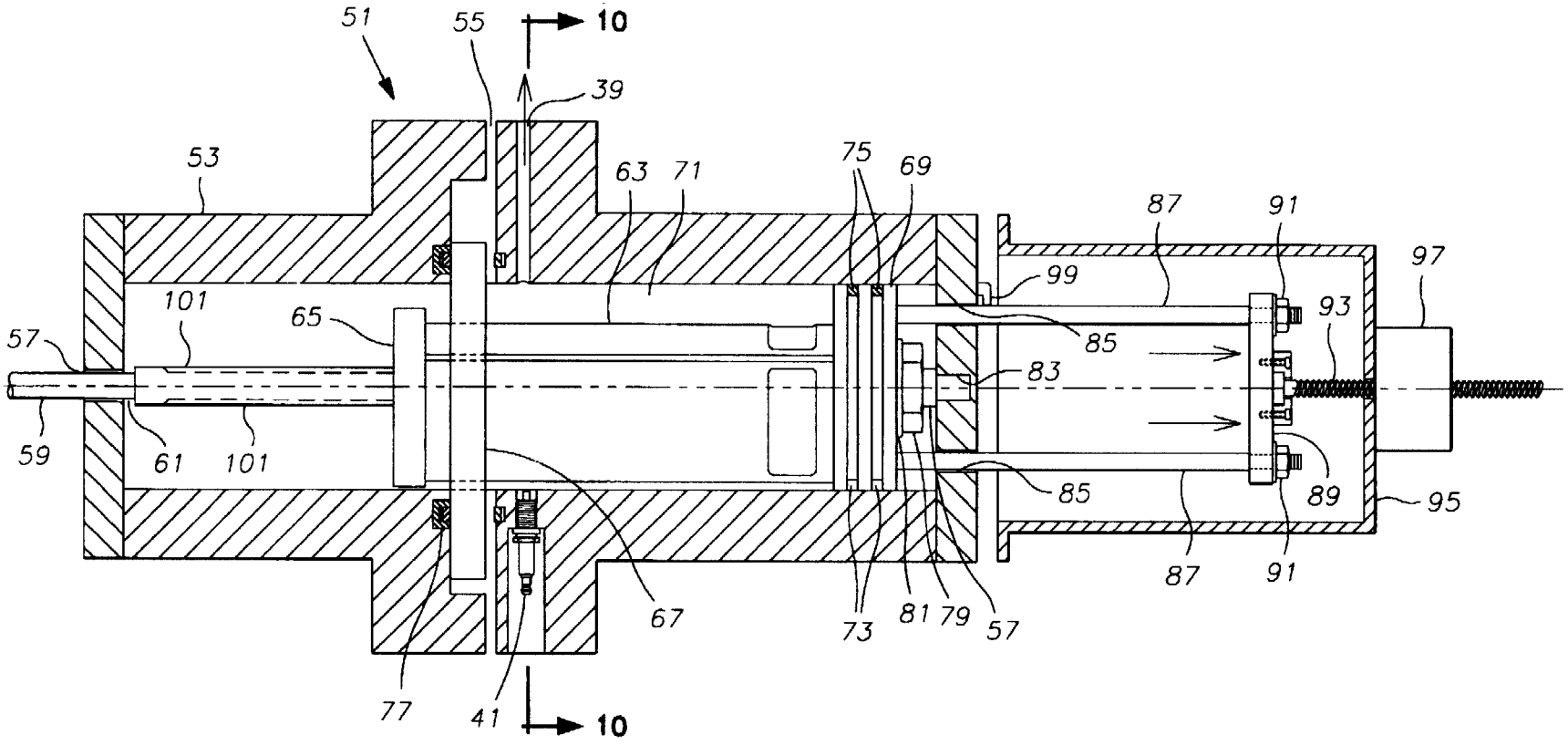
FIG. 5 is a semi-sectional view of the engine of the present invention illustrating sectional views of the housing and a non-sectional view of the engine internals, the engine in a first position maximizing the combustion volume.

Referring to FIG. 5, a side semi-sectional view of an engine 51 is shown without the details of cooling water ports 25 and other engine wall structures as would be found in a typical rotary engine. A housing 53 is divided by a gap 55 only for illustration purposes. During operation, the engine 51 gap 55 would be eliminated. Beginning at the left, a axially stationary rotor shaft 57 protrudes through the housing 53, using an end bore 59. The axially stationary rotor shaft 57 has a stepped portion 61 just inside the bore 59 to keep the axially stationary rotor shaft 57 from being laterally displaced out of the housing 53.

Surrounding the axially stationary rotor shaft 57 is an elongate rotor 63. Elongate rotor 63 has a rotor end plate 65. Elongate rotor 63 is carried within a rotor plate 67 which moves eccentrically with the movement of the rotor 63. The end of the rotor 63 opposite the rotor end plate 65 is rotatably attached to a reducing piston 69. The reducing piston 69 is a rounded profile plate which is sized to closely fit the internals of the engine 51. The volume between the reducing piston 69, rotor 63, rotor plate 67, and internal surface of the housing 53 is the combustion chamber 71.

In order to control and derive work from the gasses within the combustion chamber 71, the combustion chamber 71 needs to be sealed against escape from the combustion chamber. For the reducing piston 69, a pair of axially spaced apart grooves 73 are shown which supports circular seals 75, shown in section at the upper portion of the reducing piston 75, and which will provide sealing yet enable the reducing piston 69 to be laterally displaced within the housing 53.

At points adjacent to the rotor plate 67, a more complex sealing arrangement is shown. The gap 55 has enabled some separation to show that the rotor plate 67 engages a circular seal and bearing member 77 supported by an internal wall of the housing 53, on the side of the rotor plate 67 facing away from the combustion chamber and situated to always engage the rotor plate 67 as it eccentrically moves about the inside of the housing 53. The pressure from the combustion chamber will cause the greatest force on the rotor plate to the left of the rotor plate 67 and thus a seal and bearing member 77, rather than a simple seal, will be needed. On the side of the rotor plate 67 facing the combustion chamber and only about the portion of the rotor plate 67 which faces an internal wall of the housing 53, a seal 78 is situated to always engage the rotor plate 67.

Although not shown in FIG. 5, a second set of sealing structures seal the rotor 63 with respect to the rotor plate 67 and at the same time enable the rotor 63 to be laterally displaced through the rotor plate 67 when urged by the reducing piston 69. At the right side of the reducing piston 69 a nut 79 and self lubricating thrust bearing or washer 81 secure a rotor bearing structure to the other side of the reducing piston 69. Extending from the middle of the nut 79 and rotatably supported by a blind bore 83 in the housing 53 is the other end of the linearly stationary rotating shaft 57.

Adjacent the blind bore 83, two or more push-pull bores 85 are evenly spaced about the blind bore 83 to accommodate push-pull rods 87. The push-pull rods 87 have threaded ends and one threaded end is attached directly into the reducing piston 69, while the other ends extend through a push-pull plate 89 and are secured with nuts 91.

The center of the push-pull plate 89 is engaged by an actuator member 93 which extends through an actuator housing 95. The lateral displacement of the actuator member 93 is controlled by an actuator 97. In one form of the embodiment shown in FIG. 5, the actuator 97 may have an internally threaded member which engages the external threads of the actuator member 93. The actuation mechanism may be as swift or slow as is desired.

An actuation mechanism, regardless of type, may include a position sensor 99 to give an indication as to the exact displacement of the push-pull rods 87. The position sensor 99 shown is positioned to read the displacement directly from markings or other optical indicia directly on one of the push-pull rods.

Also seen in FIG. 5 is a pair of key slots 101 running longitudinally on either side of shaft 57 which enable rotational keying of the structures associated with the rotor 63. FIG. 5 also shows the conventional spark plug 41 and a conventional exhaust port 39. A cavity 102 is shown as a relatively large rectangular space and is provided to facilitate entry of combustion gasses into the combustion chamber 71, especially when the position of the rotor 63 is such that the combustion chamber volume is minimized. As such, the cavity will be located relatively closer to the reducing piston 69.

Figure 6:
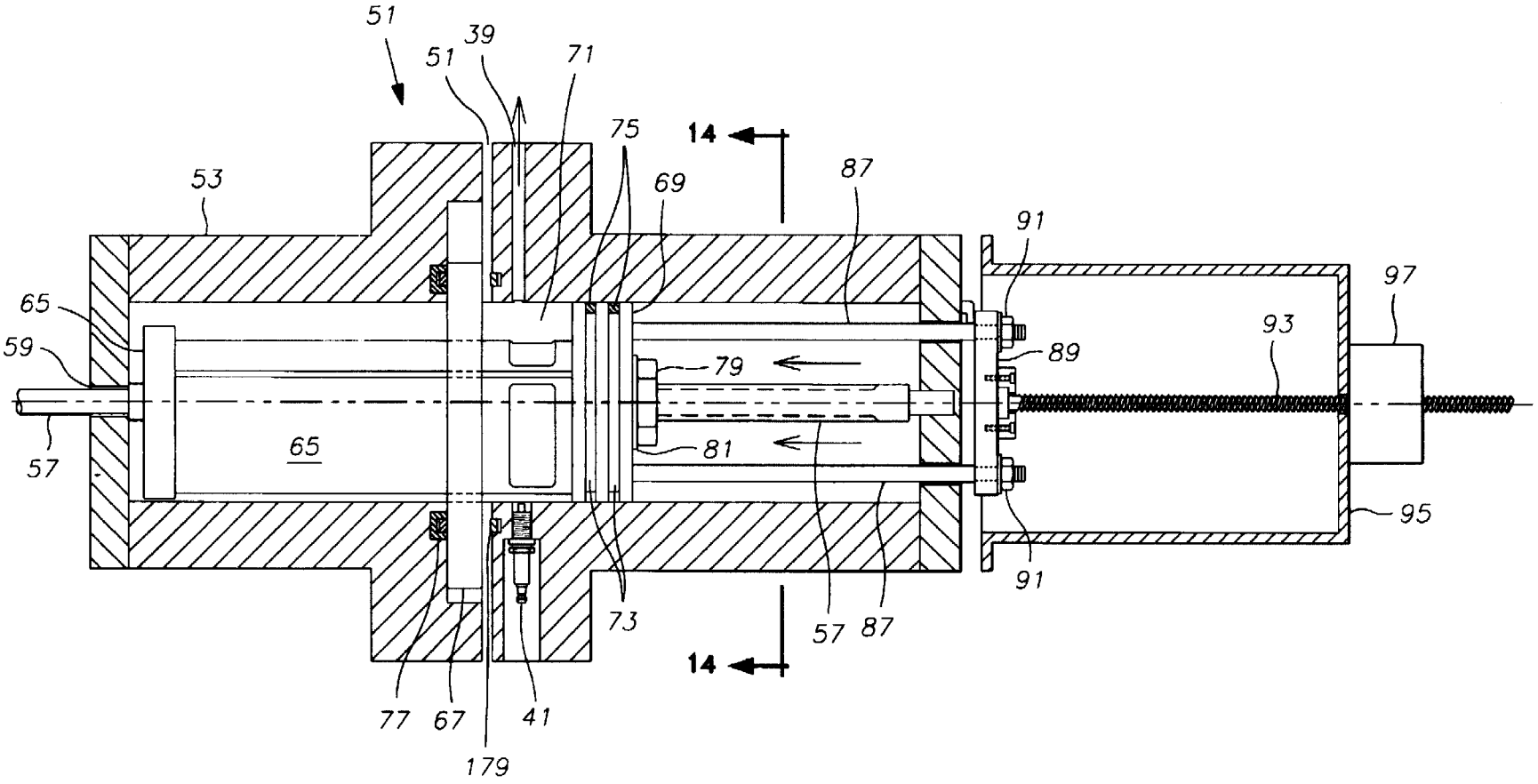
FIG. 6 is a semi-sectional view as shown in FIG. 5, but in a second position minimizing the combustion volume.

Referring to FIG. 6, the engine 51 is shown in a position in which the push-pull rods 87 are inserted all the way inside the housing 53 to the maximum extent. As can be seen, this leaves a combustion chamber 71 of relatively smaller size. The space surrounding the bulk of the extent of the rotor 63 undergoes no compression and that portion of rotor 63 simply spins within the housing 53. Since the combustion chamber 71 shown in FIG. 6 still has access to the spark plug 41, exhaust manifold 55 and intake manifold 37 (not shown), combustion can continue even though the volume and driving area of the rotor is reduced.

Actuation of the push-pull rods 87 simply push in piston 69 when less energy is required from the engine 51, and pull out piston 69 when more energy is required. The actuator 97 can be a part of a control scheme involving a microprocessor, the accelerator, or any other engine aspect or quantity.

Figure 7:
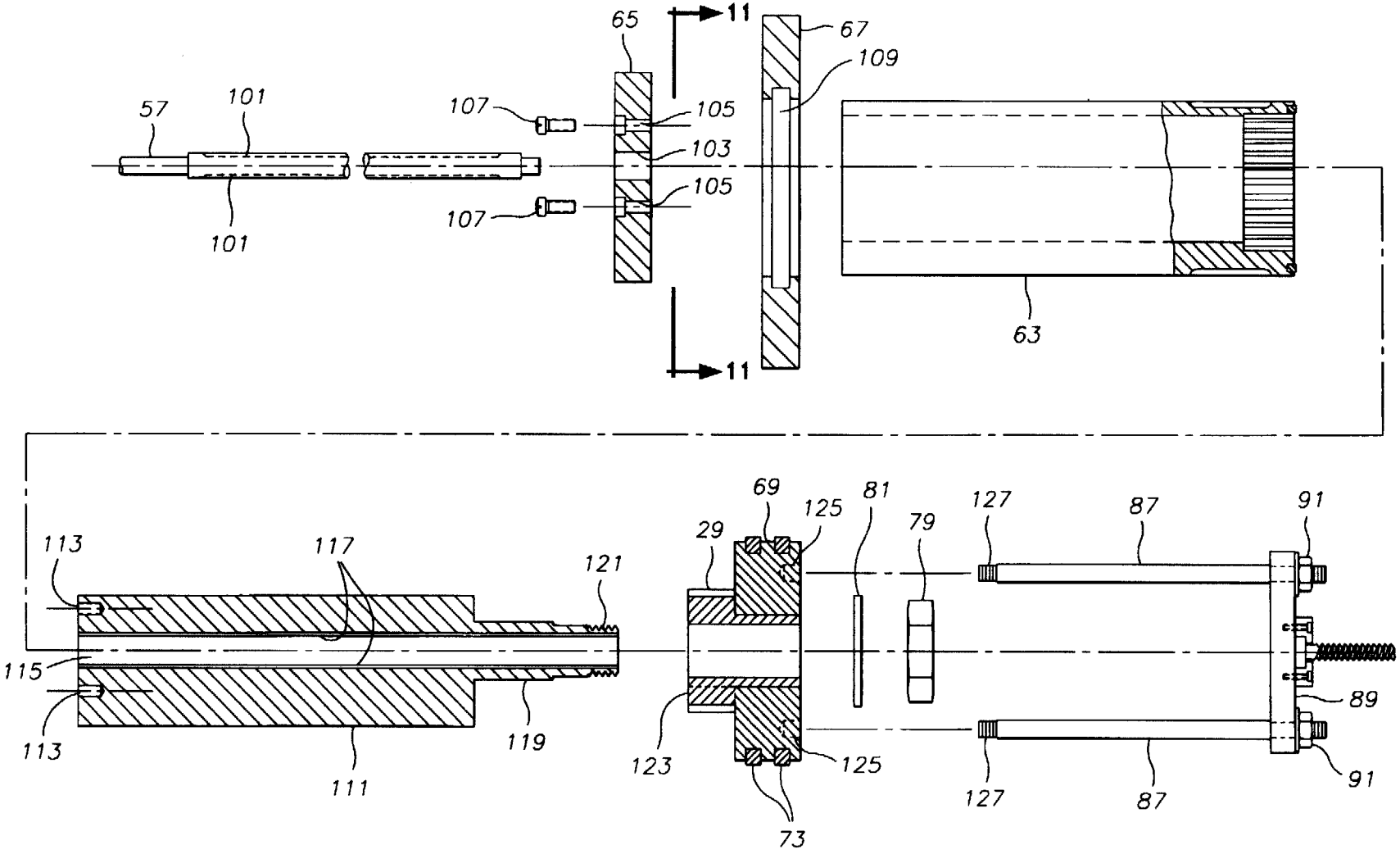
FIG. 7 is an exploded view of the rotor and associated structures.

Referring to FIG. 7, an exploded view of the details of the structures making up portions of engine 51 are shown. Beginning at the left, the shaft 57 with key slots 101 will freely and rotatably axially slide through a bore 103 through the end plate 65. The end plate 65 also only shows a pair of tapped bolt apertures 105 and a pair of bolts 107 of a total number which will secure the end plate 65 to the rotor assembly.

Figure 15:
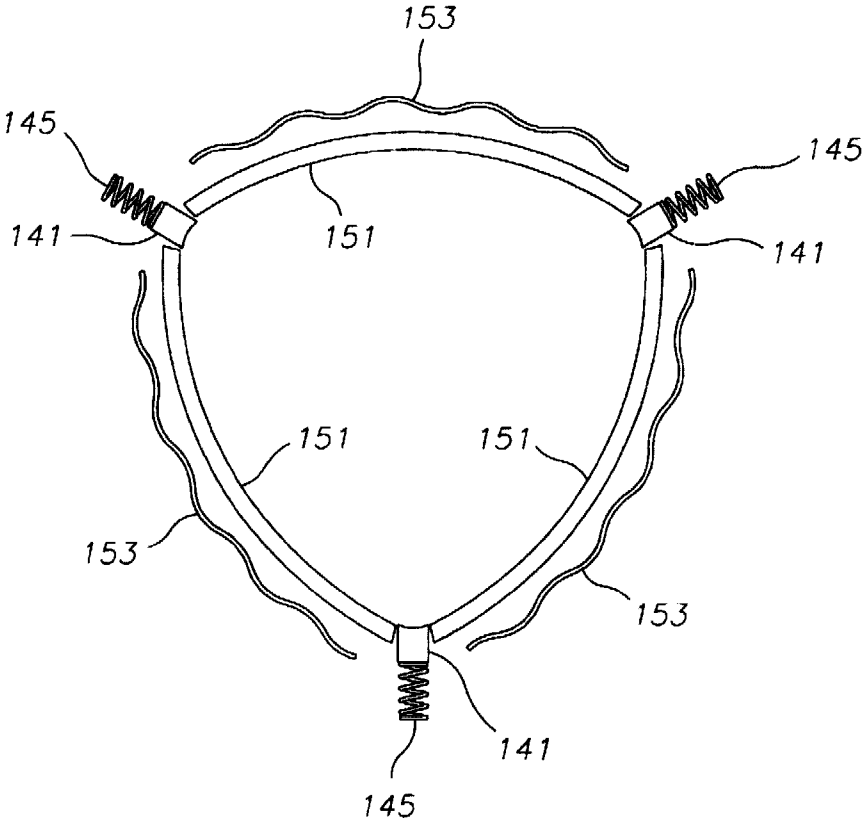
FIG. 15 is an orientational view of the sealing structure used against the rotor.

Rotor plate 67 is shown in section and defines a bowed slot 109 which will support an ordinary composite seal which may be springably urged by a wavy spring, and which will be shown in an orientational view in FIG. 15. In fact, the triangular shape of the rotor is sealed by three such bowed slots 109 along the greater periphery around the rotor 63, and with three more specialized seals for the edges of the rotor 63 to be discussed.

The rotor 63 appears somewhat hollow and as having a thicker wall dimension on one side than the other, but this is only due to its triangular shape and that the upper section is through the midpoint of a wall, while the lower section is through an angled portion. At the end of the rotor 63, the internally disposed rotor gear 35 is seen. At the lower left of FIG. 7, an enlarged eccentric shaft 111 has a plurality of threaded bores 113, although only a pair are shown, for engaging the bolts 107 to lock the end plate 65 onto the left side of the eccentric shaft 111. The eccentric shaft 111 has an internal bore 115 having a pair of key ribs 117 to permit the eccentric shaft 111 to be axially displaced with respect to shaft 57 while supplying mechanical power to the shaft 57. The eccentric shaft 111 leads to a reduced diameter portion 119 and having a threaded end 121 for engaging the nut 79.

Shown within the reducing piston 69 is a bearing member 123. The bearing member 123 is connected to and perhaps may even be formed integrally with the stationary gear 29. The bearing 123 secures the eccentric shaft from the right with the nut 79, while the eccentric shaft 111 secures the rotor 63 by the use of the end plate 65. In this configuration, the reducing piston will not turn while much of the other structures are allowed to turn, and the reducing piston can be actuated to move laterally while keeping the rotor assembly together as a unit. Also a plurality of threaded bores 125, a pair of which are shown, which engage the threaded ends 127 of the push-pull rods 87.

Figure 8:
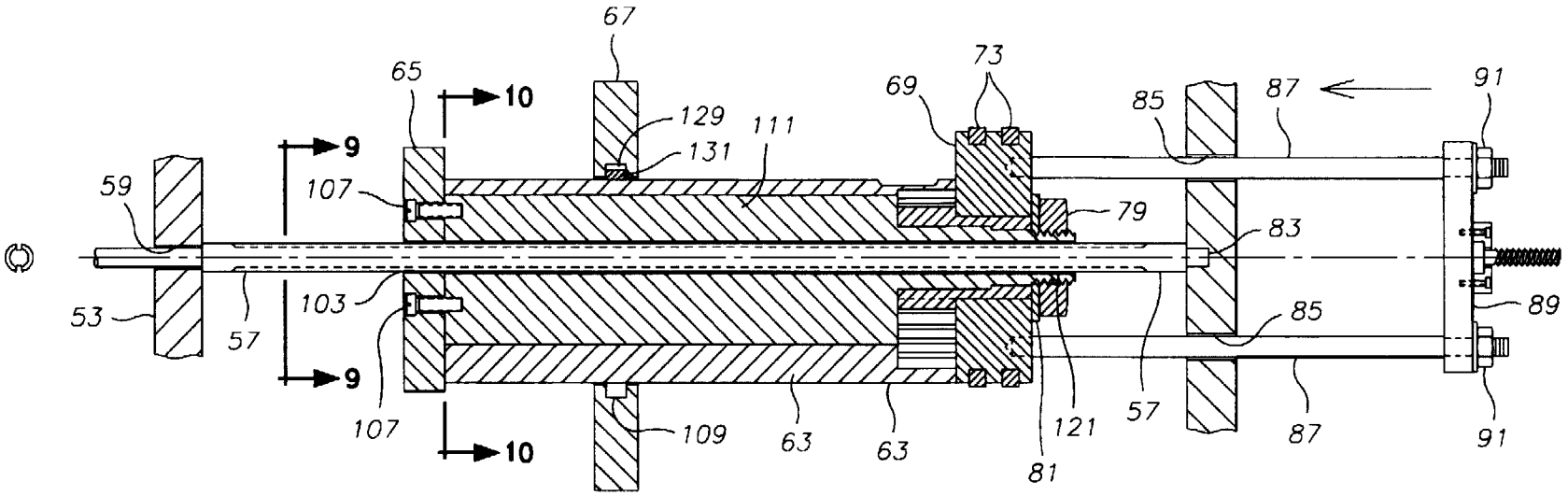
FIG. 8 is an assembled view of the rotor and associated structures.

FIG. 8 is an assembled view of the structures shown in FIG. 7 and as can be further seen within the slot 109, a wavy spring 129 supports a composite bearing material 131 against the outer surface of the rotor 63. With this configuration, the rotor 63 may be shifted to the left or to the right and without breaching the integrity of the seal nor permitting any significant amounts of combustion materials to escape between the rotor 63 and the rotor plate 67.

Figure 10:
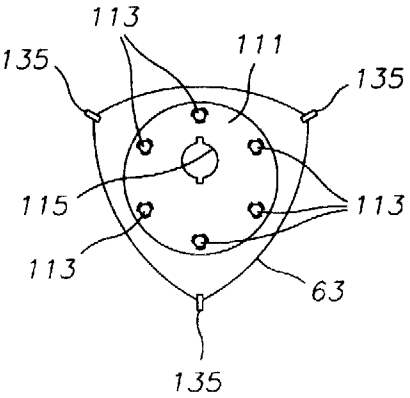
FIG. 10 is an end view taken along line 10—10 of FIG. 8 and illustrating the threaded apertures within an eccentric shaft which are used to support the rotor plate of FIG. 9.
Figure 9:
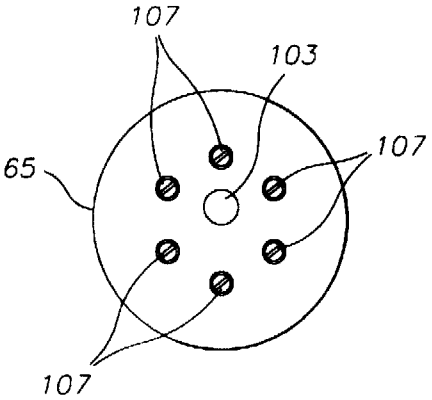
FIG. 9 is an end view of the rotor end plate shown in FIG. 8 and taken along line 9—9 of FIG. 5 and illustrating the distribution of bolt heads securing the rotor plate.

Referring to FIG. 9, a view taken along line 9—9 of FIG. 8 illustrates the uneven distribution of the bolts 107 about the bore 103. Referring to FIG. 10, a view taken along line 10—10 of FIG. 8 shows the outer surfaces of the rotor 63 and in particular the wiping seals 135 which are located at each rounded corner of each side of the rotor 63. The rotor 63 is shown surrounding the eccentric shaft 111. The threaded bores 113 in the eccentric shaft 111 are also shown.

Figure 11:
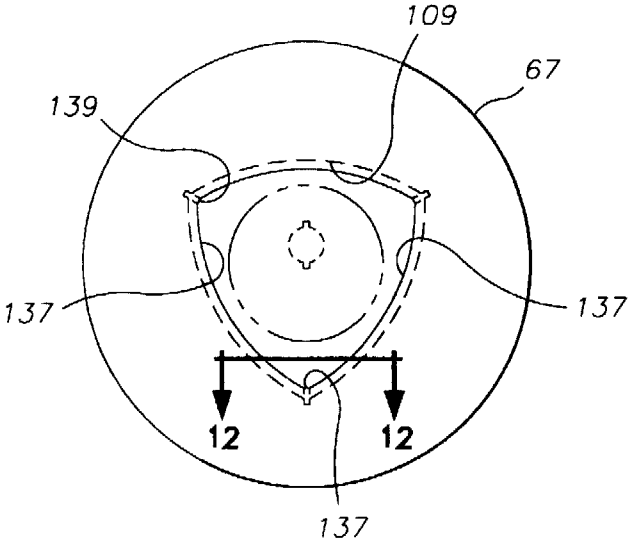
FIG. 11 is an end view of the rotor plate of FIGS. 5–8 and illustrating the open space which will slidably and sealably accommodate the rotor and further illustrating sealing details thereof.

Referring to FIG. 11, a view taken along line 11—11 of FIG. 7 gives an end view of the rotor plate and its defining elongate surfaces 137 which define the slot 109 and which are bordered by abbreviated slots 139 at the apex of any two of the elongate surfaces 137. Assuming that the rotor 63 has a close fit with respect to the surfaces 137, the seals 131 shown in FIG. 8 as urged by the springs 129 will complete the sealing.

However, the internal opening in the rotor plate 67 must also accommodate and seal against the edges of the wiping seals 135. The slots 139 help accommodate the seals 135, but additional sealing help is also provided.

Figure 12:
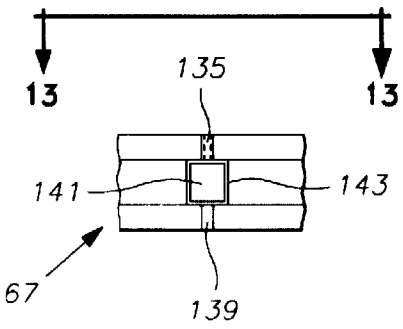
FIG. 12 is a view taken along line 12—12 of FIG. 11 and looking into the slot and square seal aperture of the rotor plate of FIG. 11.

Referring to FIG. 12, a view taken along line 12—12 of FIG. 11 looks straight into slot 139. At the lower portion of the rotor plate 67 the slot 139 carries a dashed line structure illustrating accommodation of the wiping seal 135 at it begins to traverse the rotor plate 67. At the center of the view of the rotor plate 67 shown in FIG. 12, a square structure is shown which is a seal member 141 which is axially urged toward the reader. The seal member 141 will press against the wiping seal 135 and partially block the slot 139. The partial blocking of the slot 139 only need be a length between the tip end of the wiping seal 135 and the greatest extent of the slot 135, and therefore the seal member 141 does not have very much space to seal against.

Figure 13:
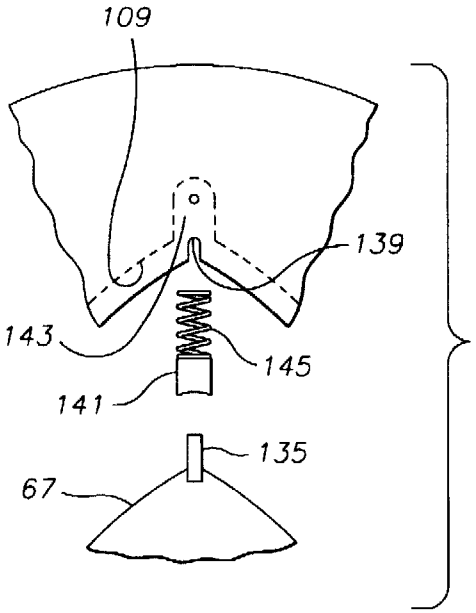
FIG. 13 is a detail as taken along line 13—13 of FIG. 12 and illustrating a small exploded view of the seal which abuts the wiping seal of the rotor.

Referring to FIG. 13, a view taken along line 13—13 of FIG. 12 shows the seal member 141 displaced from its square bore 143 and being connected to and urged by a spring 145. The seal member 141 is urged outward when displaced back into its square bore 143 and against the spring 145. Once this arrangement is set, and once the seal 131 is also in place, the rotor 63 will be completely sealed against its opening in the rotor plate 67.

Figure 14:
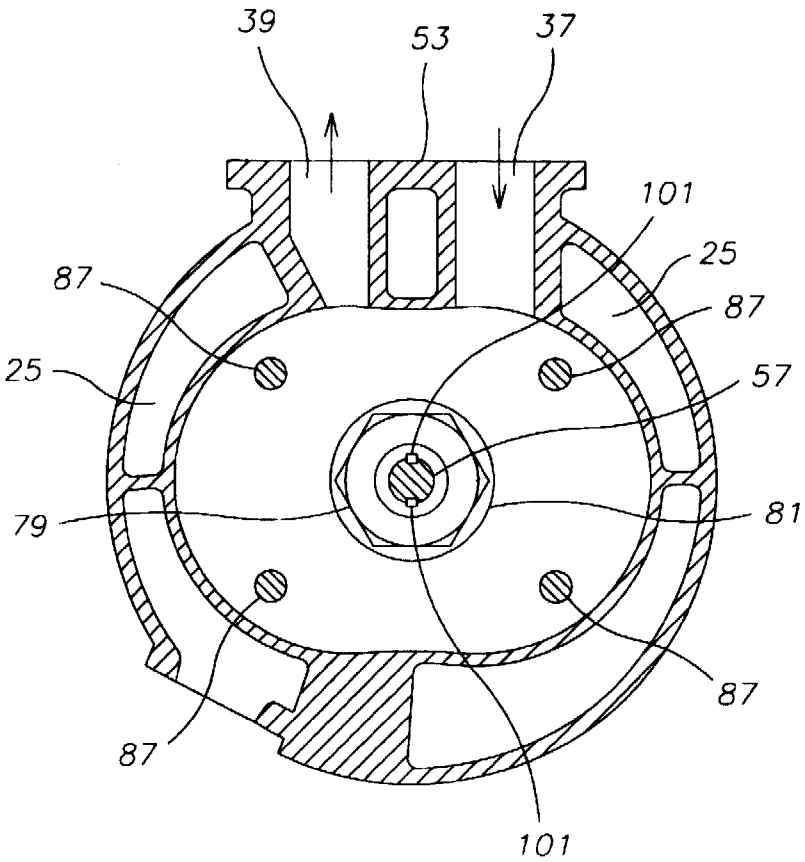
FIG. 14 is an end view, taken along line 14—14 of FIG. 6 and which gives a more complete view of the engine of the invention including water cooling spaces, inlet and outlet ports and the push-pull rods.

Referring to FIG. 14, a view taken along line 14—14 of FIG. 6 illustrates one basic possible configuration of the engine 51 and also frames engine 51 in an orientation similar to that shown in prior art FIGS. 1–4, simply in order to finally orient the inventive engine 51 with respect to conventional engines. The inlet manifold 37, exhaust manifold 39 and engine housing 51 is clearly seen and includes the cooling water ports 25. At the center, the shaft 57 can bee seen as having key slots 101. The nut 79 and washer 81 is clearly visible. A configuration of four push-pull rods 87 are arranged roughly evenly displaced from the shaft 57 and in order to apply an even pressure to the reducing piston 69.

Referring to FIG. 15, and for completeness, an exploded view of the sealing structures in relative position are shown to illustrate how well the rotor 63 is sealed. Between each of the spring 145 and seal 141 sets extends a curved elongate seal 151, and which is backed up by a wavy spring 153. When assembled in the bowed slots 109, the wavy spring 153 evenly urges the curved elongate seal 151 against the surface of the rotor 63.

Based upon computations associated with the design of engine 51, it is expected that a fuel savings of from 60% to about 70% will be achieved. In normal operation, for example, when climbing a hill the engine 51 displacement will be maximized. When driving on open, flat roads, the engine displacement will be reduced to a level to maximize fuel efficiency. In some instances, the control can be set to maximize engine 51 displacement based upon driving habits, or when more power is needed in accelerating from a standstill.

While the present invention has been described in terms of a variable displacement engine, and actuator system, one skilled in the art will realize that the structure and techniques of the present invention can be applied to many similar devices. The present invention may be applied in any situation where mechanical efficiency and variable use of the capacity of an engine is desired. Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A variable displacement rotary engine comprising:

an engine housing having an internal space and an internal wall;

a non-rotating reducing piston laterally displaceable within said internal space;

a rotor rotatably supported by said reducing piston and said engine housing, and laterally displaceable with said reducing piston; and a rotor plate surrounding said rotor, said rotor slidably and sealably displaceable with respect to said rotor plate, said rotor plate rotatable within said engine housing and sealably engaged with said engine housing to define a combustion volume between said rotor plate, said rotor, said reducing piston and said internal wall of said engine housing, said displacement of said reducing piston to vary said combustion volume of said engine.

2. The variable displacement rotary engine of claim 1 and further comprising a push-pull rod connected between said reducing piston and the outside of said engine housing and actuatable to laterally displace said reducing piston within said internal space.

3. The variable displacement rotary engine of claim 2 and further comprising an actuator, connected to said push-pull rod to actuate said push-pull rod to displace said reducing piston to vary said combustion volume of said engine.

4. A variable displacement rotary engine comprising:

an engine housing having an internal space and an internal wall;

a reducing piston laterally displaceable within said internal space;

a rotor rotatably supported by said reducing piston and said engine housing, and laterally displaceable with said reducing piston;

a rotor plate surrounding said rotor, said rotor slidably and sealably displaceable with respect to said rotor plate, said rotor plate rotatable within said engine housing and sealably engaged with said engine housing to define a combustion volume between said rotor plate, said rotor, said reducing piston and said internal wall of said engine housing, said displacement of said reducing piston to vary said combustion volume of said engine;

a push-pull rod connected between said reducing piston and the outside of said engine housing and actuatable to laterally displace said reducing piston within said internal space;

an actuator, connected to said push-pull rod to actuate said push-pull rod to displace said reducing piston to vary said combustion volume of said engine; and a position sensor proximate to said push-pull rod to measure the displacement of said push-pull rod into and out of said engine housing.

5. The variable displacement rotary engine of claim 1 and further comprising a power output shaft having a first end extending out of said engine housing and rotatable with said rotor and wherein said rotor is axially displaceable with respect to said power output shaft.

6. The variable displacement rotary engine of claim 1 and further comprising an (acentric) eccentric shaft carried within said rotor and rotatably supporting said rotor with respect to said reducing piston and said engine housing.

7. The variable displacement rotary engine of claim 1 wherein said rotor has a broad side and a wiper, said rotor plate further includes a first side and a second side and an opening in the middle of said rotor plate having an shape generally matching the outside shape of said rotor and further comprising:

a surface seal carried between said first side and said second side of said rotor plate and opposing said broad side; and a wiper seal carried between said first side and said second side of said rotor plate and opposing said wiper.

8. A variable displacement rotary engine comprising:

an engine housing having an internal space and an internal wall;

a reducing piston laterally displaceable within said internal space;

a rotor rotatably supported by said reducing piston and said engine housing, and laterally displaceable with said reducing piston;

a rotor plate surrounding said rotor, said rotor slidably and sealably displaceable with respect to said rotor plate, said rotor plate rotatable within said engine housing and sealably engaged with said engine housing to define a combustion volume between said rotor plate, said rotor, said reducing piston and said internal wall of said engine housing, said displacement of said reducing piston to vary said combustion volume of said engine;

and wherein said rotor has a broad side and a wiper, said rotor plate further includes a first side and a second side and an opening in the middle of said rotor plate having an shape generally matching the outside shape of said rotor and further comprising:

a surface seal carried between said first side and said second side of said rotor plate and opposing said broad side;

a wiper seal carried between said first side and said second side of said rotor plate and opposing said wiper; and wherein said opening in said rotor plate has a curved triangular shape and wherein each curved side of said curved triangular shape defines a slot between said first side and said second side and wherein said surface seal further comprises:

a spring carried in said slot; and a composite seal urged upward and out of said slot by said spring.

9. A variable displacement rotary engine comprising:

an engine housing having an internal space and an internal wall;

a reducing piston laterally displaceable within said internal space;

a rotor rotatably supported by said reducing piston and said engine housing, and laterally displaceable with said reducing piston;

a rotor plate surrounding said rotor, said rotor slidably and sealably displaceable with respect to said rotor plate, said rotor plate rotatable within said engine housing and sealably engaged with said engine housing to define a combustion volume between said rotor plate, said rotor, said reducing piston and said internal wall of said engine housing, said displacement of said reducing piston to vary said combustion volume of said engine;

and wherein said rotor has a broad side and a wiper, said rotor plate further includes a first side and a second side and an opening in the middle of said rotor plate having an shape generally matching the outside shape of said rotor and further comprising:

a surface seal carried between said first side and said second side of said rotor plate and opposing said broad side;

a wiper seal carried between said first side and said second side of said rotor plate and opposing said wiper; and wherein said opening in said rotor plate has a curved triangular shape and wherein curved angle of said curved triangular shape defines a bore extending radially away from the center of said rotor plate and wherein said wiper seal further comprises:

a spring carried in said bore; and a composite seal urged upward and out of said bore by said spring.

10. A variable displacement rotary engine comprising:

an engine housing having an internal space and an internal wall, and wherein said engine housing further includes:

an inlet manifold adjacent said rotor plate;

an exhaust manifold adjacent said rotor plate; and a spark plug adjacent said rotor plate;

a reducing piston laterally displaceable within said internal space;

a rotor rotatably supported by said reducing piston and said engine housing, and laterally displaceable with said reducing piston; and a rotor plate surrounding said rotor, said rotor slidably and sealably displaceable with respect to said rotor plate, said rotor plate rotatable within said engine housing and sealably engaged with said engine housing to define a combustion volume between said rotor plate, said rotor, said reducing piston and said internal wall of said engine housing, said displacement of said reducing piston to vary said combustion volume of said engine.

11. The variable displacement rotary engine of claim 1 and further comprising a power output shaft having a first end extending out of said engine housing and rotatable with said rotor and wherein said rotor is axially displaceable with respect to said power output shaft.

12. A variable displacement rotary engine comprising:

an engine housing having an internal space and an internal wall;

a reducing piston laterally displaceable within said internal space;

a rotor rotatably supported by said reducing piston and said engine housing, and laterally displaceable with said reducing piston, and wherein said rotor has a cavity to move gasses from one side of said rotor to another; and a rotor plate surrounding said rotor, said rotor slidably and sealably displaceable with respect to said rotor plate, said rotor plate rotatable within said engine housing and sealably engaged with said engine housing to define a combustion volume between said rotor plate, said rotor, said reducing piston and said internal wall of said engine housing, said displacement of said reducing piston to vary said combustion volume of said engine.

13. A variable displacement rotary engine comprising:

an engine housing having an internal space and an internal wall;

a reducing piston laterally displaceable within said internal space and supported by said engine housing;

a rotor rotatably supported by said reducing piston, and laterally displaceable with said reducing piston;

a rotor plate surrounding said rotor, said rotor slidably and sealably displaceable with respect to said rotor plate, said rotor plate rotatable within said engine housing and sealably engaged with said engine housing to define a combustion volume between said rotor plate, said rotor, said reducing piston and said internal wall of said engine housing, said displacement of said reducing piston to vary said combustion volume of said engine; and a direct mechanical link having a first end attached to said reducing piston and a second end extending outside said engine housing and actuatable into and out of said housing to laterally displace said reducing piston laterally within said internal space.

14. The variable displacement rotary engine as recited in claim 13 wherein said rotor plate is radially and rotationally displaceable within said engine housing and having an aperture, said rotor plate surrounding said rotor through said aperture, and wherein the outer surface of said rotor has a triangular shape and wherein said aperture of said rotor plate conforms to said triangular shape.

* * * * *